United States Patent [19]

Brown

[11] 4,409,702

[45] Oct. 18, 1983

[54] UNIVERSAL BRUSH PLATE ASSEMBLY

[75] Inventor: Robert S. Brown, Spartanburg, S.C.

[73] Assignee: Milliken Research Corporation, Spartanburg, S.C.

[21] Appl. No.: 411,045

[22] Filed: Aug. 24, 1982

Related U.S. Application Data

[63] Continuation of Ser. No. 272,879, Jun. 12, 1981, abandoned.

[51] Int. Cl.[3] ..... A47L 11/164

[52] U.S. Cl. ..... 15/180; 15/49 R

[58] Field of Search ..... 15/49 R, 50 R, 87, 98, 15/180, 385; 51/177

[56] References Cited

U.S. PATENT DOCUMENTS 2,689,368 9/1954 Finnell ..... 15/50 R X 3,518,709 7/1970 Zemke et al. ..... 15/49 R X 4,183,112 1/1980 Brown et al. ..... 15/50 R 4,322,920 4/1982 Wells ..... 15/180 X

FOREIGN PATENT DOCUMENTS 493141 5/1950 Belgium ..... 15/180

*Primary Examiner*—Edward L. Roberts

*Attorney, Agent, or Firm*—George M. Fisher; H. William Petry

[57] ABSTRACT

A scrubbing plate assembly for use on a carpet scrubbing machine is disclosed. The assembly comprises a mounting plate and a set of brushes which are individually attached to the mounting plate at some predetermined radial orientation. By uniformly changing the angle at which each brush is mounted on the plate, the plate assembly can replace conventional circular brushes having a variety of different diameters.

9 Claims, 4 Drawing Figures

UNIVERSAL BRUSH PLATE ASSEMBLY

This is a continuation, of application Ser. No. 272,879 filed June 12, 1981, now abandoned.

This invention relates to an apparatus for use in conjunction with a device for scrubbing floor surfaces. In particular, this invention relates to a brush plate assembly which is particularly suited for use with a variety of brush-type scrubbing machines used for cleaning floor coverings, particularly carpets.

Recently, a radically new approach to cleaning carpets has been developed which uses a powdered cleaning composition containing a mixture of extremely porous solid particles and a solvent. This new cleaning composition is described in U.S. Pat. No. 4,013,594, and has proved especially effective in removing soil from carpets. Only a short interval is required between application and removal of the powdered cleaning composition. Using this new cleaning composition, it has now become possible to clean carpets in offices and stores during working hours with little disruption to normal affairs. However, this progress in cleaning compositions has exposed shortcomings in the carpet cleaning machines known to the prior art.

When the devices of the prior art are used with this new powdered composition, it is found that some areas of the carpet are cleaned much better than other areas, and that a streaked appearance results. It is theorized that this streaked appearance is due to the fact that the powder, unlike a liquid, must be physically moved into intimate contact with the fibers to be cleaned. Therefore, to obtain the full benefit of the powdered cleaning composition, it is thought to be desirable to provide a device which is capable of transmitting a great deal of energy to the carpet in the form of scrubbing action in order to bring the powdered cleaning composition into intimate contact with the fiber, while distributing this energy uniformly over the areas which is scrubbed. Furthermore, it is desirable to provide a device which minimizes redistribution of the powder which has been applied to the carpet. It is particularly important, where powdered cleaning agents are employed, to employ a scrubbing machine which is capable of thoroughly and uniformly bringing the cleaning agent into intimate contact with the carpet fibers.

This invention relates to a brush plate assembly which is adaptable for use with a wide variety of carpet scrubbing machines of the type which uses a circular-type brush rotating in a plane parallel to the floor to achieve the necessary scrubbing action, and which is also adaptable for use on a variety of carpet types when used with such machines. By employing a plurality of individual brushes of a standard size and type which can be mounted in a variety of positions on a single brush plate of standardized dimension, and by employing a centrally located, weight-supporting glide plate, a single brush plate with a set of standardized brushes can be used to construct a brush plate assembly which can be used on carpet scrubbing machines normally requiring brush plate assemblies of different overall diameters, and which can be used on carpets having different pile heights and densities. When used on these machines, the brush plate assembly of this invention results in carpets which are thoroughly and uniformly cleaned, and yields superior results when used in conjunction with powdered cleaning compositions, when compared to carpet cleaning machines known to the prior art. In addition, by having an adapter ring which may be mounted on the brush plate, the brush plate assembly may be mounted in carpet scrubbing machines having different sized drive hubs.

BRIEF DESCRIPTION OF THE DRAWINGS

FIG. 1 shows a view of a type of carpet scrubbing machine to which the brush plate assembly of this invention may be adapted. The brush plate assembly is specifically designed to accommodate a wide variety of machines, i.e., machines having drive hub diameters of five inches, and an overall brush scrubbing diameter ranging from thirteen inches to sixteen inches, or, by changing to a mounting plate having a slightly larger diameter, from seventeen inches to twenty inches. As will be evident from the following description, the invention may be adapted easily for other brush diameters. With an adapter ring, also described herein, the brush plate assembly may also be adapted for use with carpet cleaning machines having a drive hub diameter smaller than five inches. Because said carpet scrubbing machines, apart from the brush plate assembly, are a part of the prior art, the description hereinbelow will concentrate on details of the brush plate assembly per se.

As shown in FIGS. 2, 3, and 4, the brush plate assembly of this invention is comprised of an annular mounting plate 10 having an outer diameter of approximately eleven inches and an inner diameter of approximately six inches, and onto one side of which is mounted a plurality of individual brushes 20. Each brush is comprised of a rigid back 22, which may be made of high density polyethylene or other suitable materal, into which are embedded a plurality of nylon bristles, arranged in small tufts 24. Other bristle arrangements and constructions may be used if desired. Rigid back 22 is substantially flat to facilitate mounting on flat mounting plate 10. The lateral cross sectional shape of the back, the size of the back, and the overall configuration of the bristle groups on the back may be varied. For example, a brush which is essentially symmetric in lateral cross section along its length (e.g., having a boat bow-like tapered front similar to a common, hand-held scrubbing brush) may be used. It has been found advantageous, however, to orient the brushes such that, when in use, the brushes tend to ride over the cleaning powder which has been thrown along the outward edge of the brush ahead. This minimizes redistribution of the powder by the brushes and minimizes uneven cleaning. The orientation of the individual brushes in the mounting plate should form an open cavity such as 15 in FIG. 3, which, given the direction of brush rotation, causes the open end of the cavity 15 to move ahead of the brush, rather than trailing behind it. In this configuration the leading bristles of a given individual brush extend radially outwardly from the mounting plate a greater distance than the trailing bristles of the brush immediately ahead of the given brush.

Figure 4:
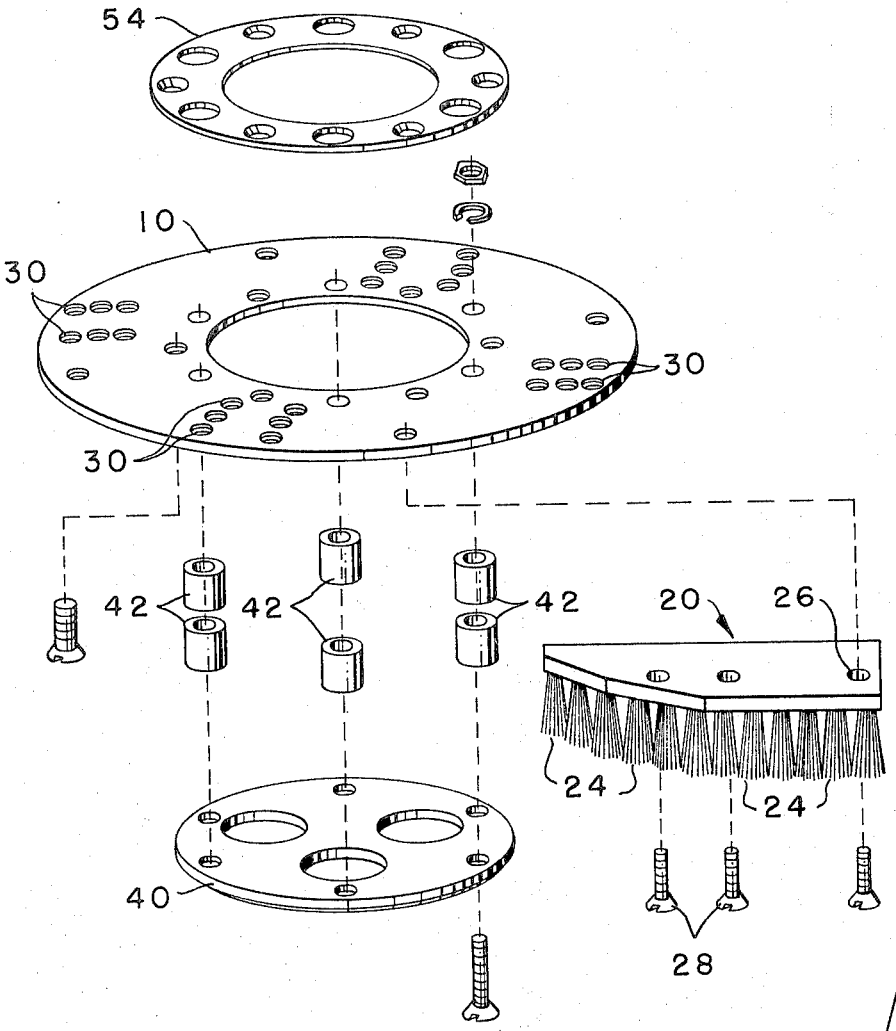
FIG. 4 is a perspective, exploded view of one embodiment of the brush plate assembly of this invention.
Figure 1:
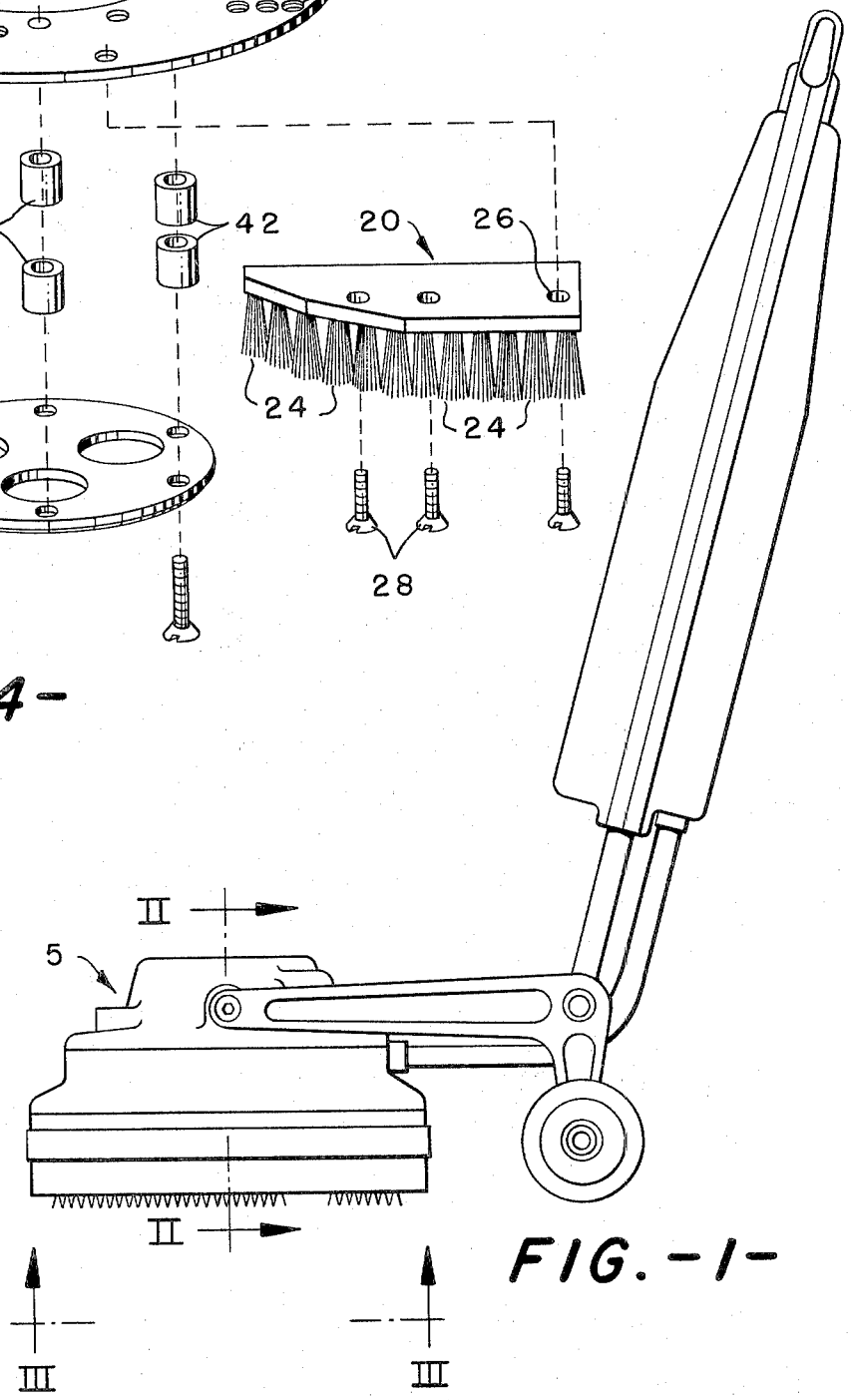
FIG. 1 schematically depicts an overall side elevation of a carpet scrubbing machine having a brush plate assembly of the type described herein.
Figure 2:
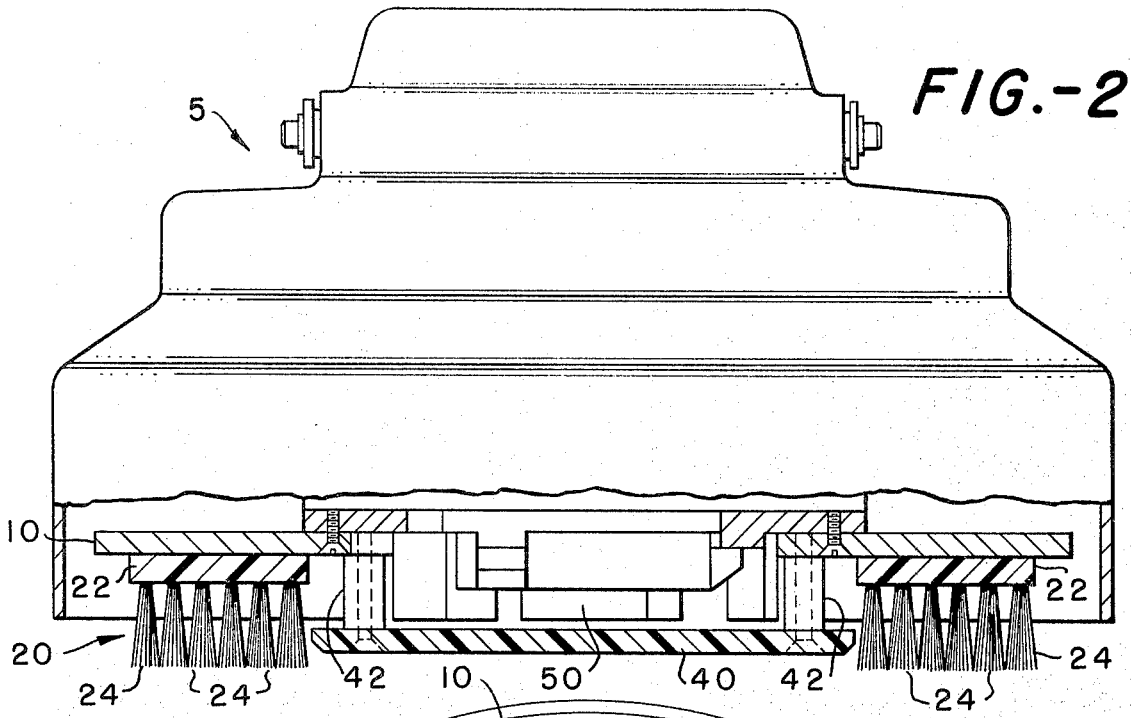
FIG. 2 is a section view through line 2—2 of FIG. 1.
Figure 3:
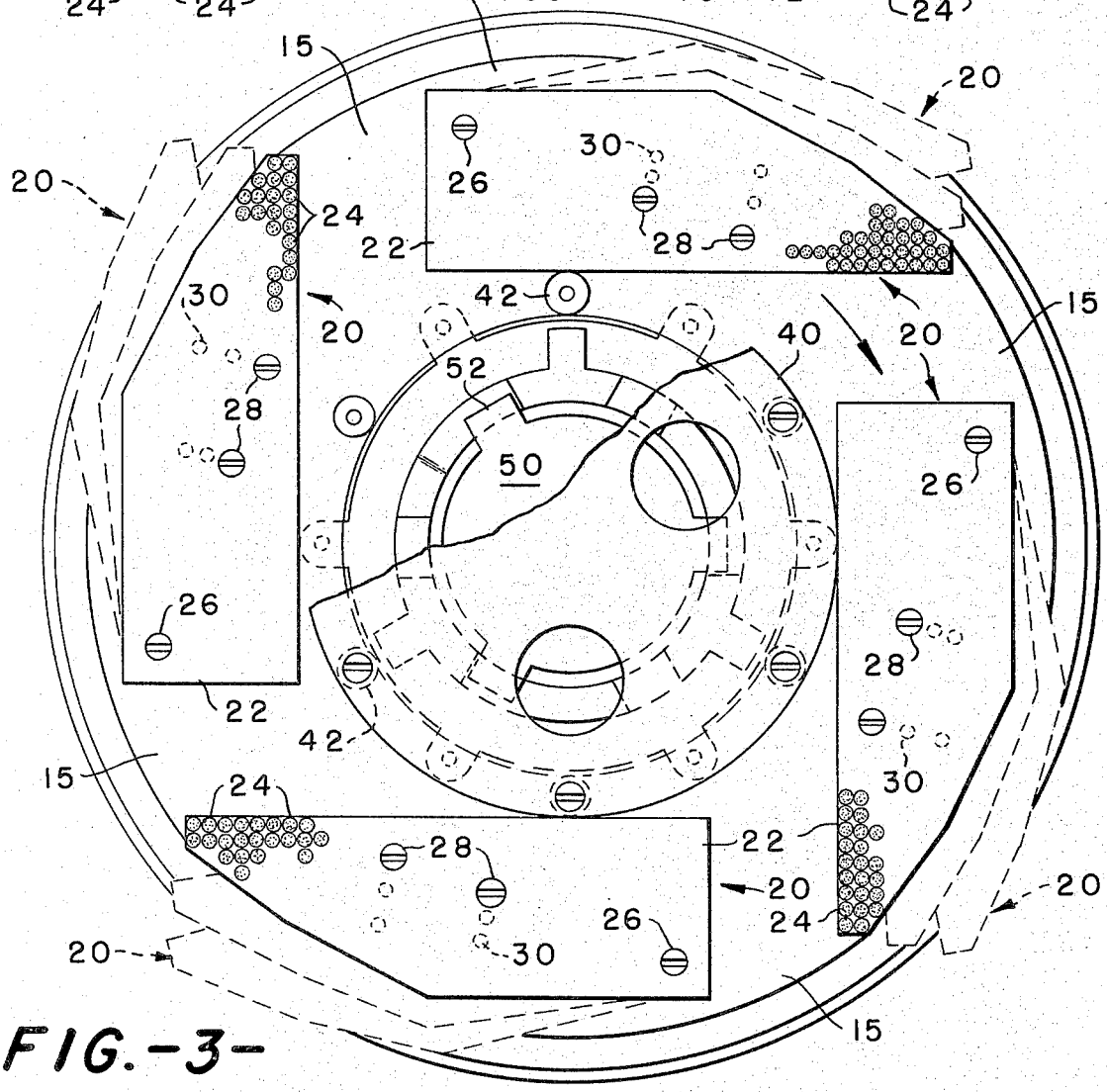
FIG. 3 is a bottom view along line 3—3 of FIG. 1.

Each brush back 22 carries a pivoting element 26, which may be, for example, a hole through which a bolt is fitted. The purpose of the pivoting element 26 is to assist in solidly attaching the individual brushes equidistantly around the circumference of mounting plate 10, yet allow the individual brushes 20 to pivot in a plane parallel to mounting plate 10, thereby permitting the forward end of each brush to move radially inwardly or outwardly with respect to the mounting plate. Each brush back 22 carries one or more mounting holes, through which additional bolts 20 may be placed. These mounting holes are intended to become aligned with cooperating apertures 30, found along an arcuate path in the mounting plate 10, when a given brush 20 is pivoted inwardly or outwardly about said pivoting element 26. By correct, uniform placement of the holes in each brush back 22 and apertures in appropriate locations around the circumference of brush plate 10, it is possible to pivot each brush about its individual pivoting element 26, causing the mounting hole or holes in the brush back 22 to become aligned with the appropriate cooperating apertures in brush plate 10; it is then possible to pass a bolt or other fastening means through the aligned holes, thereby solidly fixing each brush 20 equidistantly spaced around the circumference of mounting plate 10 and in the same position, relative to the center of mounting plate 10. In this way, by merely moving the relative position of each brush 20 on the mounting plate 10, a circular brush unit having any of several different overall scrubbing diameters may be constructed from the same components, as is depicted in phantom in FIG. 3. For example, a given mounting plate of approximately eleven inches in diameter and four individual, identical brushes may be used to construct a circular brush having an effective scrubbing diameter of thirteen, fourteen, fifteen and sixteen inches. This allows enormous flexibility in that inventories of replacement brush plates or individual brushes may be standardized for a wide range of different machines.

Considerable friction is generated between the brush bristles and the carpet fibers being cleaned, which means that substantial effort must be expended to move a brush-type carpet cleaning machine on the carpet surface being cleaned. Where a liquid cleaner is being used, the liquid is sufficient to reduce the friction and allow the carpet machine to be moved somewhat easily. Where a powdered cleaner is used, however, other means to reduce friction must be used. In the brush plate assembly of this invention, a circular glide plate 40 having a diameter of approximately six inches, positioned in the center of annular mounting plate 10, is used. This glide plate may be made of a relatively low friction plastic material, such as polyterafluoroethylene. The glide plate is mounted to the brush plate using sleeves 42 to allow the bottom surface of plate 40 to be positioned substantially below the plane of the mounting plate 10. It has been found advantageous to position glide plate 40 to allow the tips of the brush bristles on the mounted brushes 20 to extend about 0.05 to about 0.25 inch below the surface of the glide plate 40, but other positions substantially outside this range may prove desirable under certain conditions. This permits a substantial portion of the weight of the carpet cleaning machine to which the brush plate assembly is attached to be supported on the relatively low friction bearing surface applied by glide plate 40 and allows the machine to be moved from place to place on the carpet being cleaned with relative ease. In addition, by being able to substitute sleeves of various lengths for spacing sleeves 42 it is possible to vary the degree to which brush bristles 24 will contact the carpet pile during the cleaning operation.

Carpet cleaning machines of the rotary type depicted in the figures usually have a drive hub 50 on which the brush plate assembly is locked, and which supplies the necessary power to drive the brush plate assembly in a rotary motion. This drive hub 50 is of relatively standard configuration having a series of lugs 52 around its perimeter into which portions of a cooperating lock ring, not shown, attached to the brush plate assembly may be locked. The diameter of the drive hub, however, may vary, some machines having a drive hub diameter of five inches, some machines having a drive hub diameter of four inches, etc. To accommodate this variation, the mounting plate 10 may be initially sized to fit a five inch diameter drive hub. An adapter ring 54 which may be bolted to the inner circumference of mounting plate 10 may then be used as a mounting surface for attachment of a cooperating lock ring of a smaller size which would coact with the lugs on the smaller diameter, e.g., four inch, drive hub.

I claim:

1. A scrubbing plate assembly for use on a carpet scrubbing machine, comprising:

(a) an annular mounting plate having at least one side adapted for mounting scrubbing elements thereon, said mounting plate being further adapted for attachment to a carpet scrubbing machine;

(b) a plurality of scrubbing elements, positioned about the perimeter of said mounting plate on one side thereof, each of said scrubbing elements further comprising a rigid back and flexible bristles extending from one side of said back, said back having a pivoting point of attachment whereby said back may be attached to said mounting plate, and a mounting aperture which may be made to align with any one of a series of cooperating mounting apertures in said mounting plate when any of said scrubbing elements is pivoted about its said pivoting point of attachment, and (c) means to secure rigidly each of said scrubbing elements when its respective said mounting aperture carried by said rigid back and one of said series of cooperating mounting apertures in said mounting plate are aligned.

2. The scrubbing plate assembly of claim 1, wherein said assembly further comprises an adapter means which can be attached to said mounting plate to adapt said assembly for use with carpet cleaning drive hubs of reduced diameter.

3. The scrubbing plate assembly of claim 1 wherein each of said scrubbing elements, have leading bristles and trailing bristles, and wherein each of said scrubbing elements are secured to said mounting plate in an orientation allowing the leading bristles of a second scrubbing element to extend radially outwardly from said mounting plate a greater distance than the trailing bristles of a first scrubbing element immediately ahead of said second scrubbing element.

4. The scrubbing plate assembly of claim 1, further comprising a glide plate comprising a surface capable of bearing a substantial portion of the weight of a carpet scrubbing machine of the type to which the scrubbing plate assembly is likely to be attached, said glide plate being rigidly attached to said annular mounting plate on the same side of said mounting plate as said scrubbing elements, said surface of said glide plate positioned from the central portion of said annular mounting plate a predetermined distance, said predetermined distance chosen to allow desired contact between said flexible bristles and a carpet to be cleaned.

5. The scrubbing plate assembly of claim 4, wherein said glide plate position is adjustable.

6. A substantially flat, annular mounting plate having a central aperture therein and adapted for attachment to and use with a circular style floor scrubbing machine, said plate having at least one side thereof adapted for constructing a plurality of brush configurations through the selective positioning of a plurality of individual scrubbing elements which are detachably, rigidly, and independently mountable in spaced relation around said central aperture in one of several predetermined configurations, each configuration yielding a different effective scrubbing diameter, said plate carrying a plurality of groups of mounting apertures surrounding said central aperture, each group of mounting apertures being adapted to accept bolts or similar means to position and secure a respective one of said individual scrubbing elements at a specific location and orientation around said central aperture, said mounting apertures being positioned so that said respective scrubbing elements may be collectively positioned to define a brush configuration having one of several overall scrubbing diameters.

7. The mounting plate of claim 6 which further comprises a glide plate capable of supporting a substantial portion of the weight of said floor scrubbing machine, said glide plate mounted coaxially with and substantially within the central portion of said mounting plate, and rigidly attached thereto.

8. The mounting plate of claim 6 wherein each group of mounting apertures is substantially identical in configuration.

9. The mounting plate of claim 6 wherein said mounting apertures are positioned so that said respective scrubbing elements may be positioned and secured in an orientation wherein, assuming a given direction for the rotation of said mounting plate when in use on said circular style floor scrubbing machine, the leading or initial floor-contacting portion of a given scrubbing element extends radially outwardly from said central aperture a greater distance than the trailing or final floor-contacting portion of that scrubbing element immediately preceding said given scrubbing element.

* * * * *